US007413087B2

(12) United States Patent
Kriel

(10) Patent No.: US 7,413,087 B2
(45) Date of Patent: Aug. 19, 2008

(54) SCREEN DECK

(75) Inventor: Nigel Peter Kriel, Kempton Park (ZA)

(73) Assignee: Multotec Manufacturing (PTY) Limited, Kempton Park (ZA)

( * ) Notice: Subject to any disclaimer, the term of this patent is extended or adjusted under 35 U.S.C. 154(b) by 152 days.

(21) Appl. No.: 10/504,284

(22) PCT Filed: Feb. 11, 2003

(86) PCT No.: PCT/ZA03/00017

§ 371 (c)(1),
(2), (4) Date: Mar. 21, 2005

(87) PCT Pub. No.: WO03/066243

PCT Pub. Date: Aug. 14, 2003

(65) Prior Publication Data

US 2005/0183991 A1 Aug. 25, 2005

(30) Foreign Application Priority Data

Feb. 11, 2002 (ZA) ..... 02/1139

(51) Int. Cl.
*B07B 1/49* (2006.01)

(52) U.S. Cl. ..... 209/405; 209/413; 209/414; 209/399; 209/403; 248/473

(58) Field of Classification Search ..... 209/405, 209/413, 414, 399; 248/473
See application file for complete search history.

(56) References Cited

U.S. PATENT DOCUMENTS

| | | | | | |
|---|---|---|---|---|---|
| 4,840,728 | A | * | 6/1989 | Connolly et al. | 209/405 |
| 4,960,510 | A | * | 10/1990 | Wolff | 209/405 |
| 5,112,475 | A | * | 5/1992 | Henry, Jr. | 209/399 |
| 5,372,261 | A | | 12/1994 | Galton et al. | |
| 5,398,817 | A | * | 3/1995 | Connolly et al. | 209/399 |
| 5,769,241 | A | * | 6/1998 | Woodgate | 209/399 |
| RE38,303 | E | * | 11/2003 | Askew | 209/405 |
| 6,886,697 | B2 | * | 5/2005 | Russell et al. | 209/399 |
| 7,090,083 | B2 | * | 8/2006 | Russell et al. | 209/405 |

FOREIGN PATENT DOCUMENTS

| | | |
|---|---|---|
| CL | 1517-95 | 7/1996 |
| CL | 108-00 | 10/2000 |
| CL | 3166-99 | 10/2000 |
| EP | 0243 500 | 11/1987 |
| WO | WO 00/64599 | 11/2000 |
| WO | WO 01/58602 | 8/2001 |

* cited by examiner

*Primary Examiner*—Patrick H. Mackey
*Assistant Examiner*—Terrell H Matthews
(74) *Attorney, Agent, or Firm*—Morgan & Finnegan, LLP

(57) ABSTRACT

A screen deck runner assembly (20) suitable for use in a vibratory screening machine characterized by the assembly including a saddle member (5), being configured and 420 dimensioned to removably straddle a screen deck runner (1) and to engage a screen panel (3).

16 Claims, 7 Drawing Sheets

SCREEN DECK

TECHNICAL FIELD

This invention relates to a screen deck assembly for vibratory screening machines.

BACKGROUND ART

Vibratory screening machines are well known in the bulk materials handling industry. Vibratory screening machines are used particularly for the size classification of bulk particulate materials such as mineral bearing ore. Vibratory screening machines usually consist of screen decks, supported on a vibratile frame structure, operatively linked to a motorized vibratory mechanism.

Modular-type screen decks are well known, consisting typically of a matrix of screen panels, generally mounted on a number of steel runners. The steel runners are usually mounted on a steel grid or lattice-type structure, the grid forming part of the vibratile frame structure. The vibratile frame structure, together with the motorized vibratory mechanism, is normally supplied by the manufacturer, while specialist screen deck suppliers add and supply replacement parts such as the runners and the screen panels.

The screen panels and the runners wear as the classified particulate material flow across and through the screen panel apertures as well as over the runners. The known designs of the runners are such that, although the runners do not wear as fast as the screen panels, they do have to be replaced from time to time.

As the runners provide support for the screen panels, they typically extend across the whole surface of the screen. The replacement of runners therefore usually requires the removal of all the screen panels, the unbolting of the runners from the grid, and the subsequent replacement of the runners. This procedure is time consuming and labour intensive, causing substantial equipment downtime relative to the replacement of, for example, a screen panel. When downtime is planned for replacement of worn screen panels and/or runners, it typically entails production to be stopped or reduced. The wear resistance of the screen panels as well as the runners are therefore of utmost importance to reduce wear and consequential downtime of the vibratory screening machines during refurbishment, as well as the capital costs of replacing the worn runners.

It is accordingly an object of the present invention to provide a screen deck runner assembly for vibratory screening machines that overcomes or at least partially alleviates some of the disadvantages mentioned above.

DISCLOSURE OF THE INVENTION

According to the invention there is provided a screen deck runner assembly suitable for use in a modular-type screen deck for a screening machine, the screen deck having a matrix of screen panels, mounted on a number of steel runners, the runner assembly characterized by a runner, comprising an elongate flat member; and a saddle member, configured and dimensioned to removably straddle the runner in a wear resistant and secured manner as well as releasable engage a complementary screen panel in an operative arrangement in a screen deck.

The saddle member may have engaging means for engaging the screen panel to the saddle member in a releasable manner therewith, the engaging means being integrally formed with the saddle member. Alternatively, the engaging means may comprise a separate fastener member.

The engaging means may comprise a continuous rail-type protrusion, the rail being substantially mushroom shaped in cross section and adapted to engage a complementarily shaped screen panel. Alternatively, the engaging means may comprise at least one mushroom-shaped protrusion, adapted to engage a complementary formed screen panel. Further alternatively, the engaging means may comprise at least one socket formation, configured and dimensioned to receive a complementary shaped spigot for releasably engaging the screen panel in a spigot and socket configuration. The socket formation preferably is provided with an annular sealing ridge provided around the outside of the socket's circumference.

The engaging means may be made of polymer-type material.

The saddle member may be substantially U-shaped. The saddle member may be made of high wear resistance polymer type material such as polyurethane, polyethylene, polypropylene, plastics, nylon or resin. The saddle member further may have internal rigid inserts to increase its structural rigidity.

The saddle member may be provided with quick release securing means for securing the saddle to the runner. The securing means may comprise a spigot and socket arrangement, the saddle and the runner being provided with complementary apertures for receiving spigots therethrough. The spigots preferably are of a polymer-type material.

The saddle member further may be provided with load bearing support formations for operatively supporting the associated screen panel substantially along the side of the panel.

Further according to the invention there is provided a screen deck runner assembly suitable for use in a vibratory screening machine comprising a saddle member, substantially U-shaped to enable it to straddle a screen deck runner, the saddle member being adapted for engaging a screen panel and made of high wear resistance polymeric material.

The saddle member may have engaging means for engaging the screen panel to the saddle member in a releasable manner therewith, the engaging means being integrally formed with the saddle member. Alternatively, the engaging means may comprise a separate fastener member.

The engaging means may comprise a continuous rail-type protrusion, the rail being substantially mushroom shaped in cross section and adapted to engage a complementarily shaped screen panel. Alternatively, the engaging means may comprise at least one mushroom-shaped protrusion, adapted to engage a complementary formed screen panel. Further alternatively, the engaging means may comprise at least one socket formation, configured and dimensioned to receive a complementary shaped spigot for releasably engaging the screen panel in a spigot and socket configuration. The socket formation preferably is provided with an annular sealing ridge provided around the outside of the socket's circumference.

The engaging means may be made of polymer-type material.

The saddle member may be substantially U-shaped. The saddle member may be made of high wear resistance polymer type material such as polyurethane, polyethylene, polypropylene, plastics, nylon or resin. The saddle member further may have internal rigid inserts to increase its structural rigidity.

The saddle member may be provided with quick release securing means for securing the saddle to the runner. The securing means may comprise a spigot and socket arrangement, the saddle and the runner being provided with complementary apertures for receiving spigots therethrough. The spigots preferably are of a polymer-type material.

The saddle member further may be provided with load bearing support formations for operatively supporting the associated screen panel substantially along the side of the panel.

Further according to the invention there is provided a saddle member for a screen deck runner assembly of a modular-type screen deck for a screening machine, the screen deck having a matrix of screen panels, mounted on a number of steel runners, the saddle member comprising a substantially U-shaped member, configured and dimensioned to removably straddle a runner in a wear resistant and secured manner as well as to releasable engage a complementary screen panel in an operative arrangement in a screen deck.

The saddle member may have engaging means for engaging the screen panel to the saddle member in a releasable manner therewith, the engaging means being integrally formed with the saddle member. Alternatively, the engaging means may comprise a separate fastener member.

The engaging means may comprise a continuous rail-type protrusion, the rail being substantially mushroom shaped in cross section and adapted to engage a complementarily shaped screen panel. Alternatively, the engaging means may comprise at least one mushroom-shaped protrusion, adapted to engage a complementary formed screen panel. Further alternatively, the engaging means may comprise at least one socket formation, configured and dimensioned to receive a complementary shaped spigot for releasably engaging the screen panel in a spigot and socket configuration. The socket formation preferably is provided with an annular sealing ridge provided around the outside of the socket's circumference.

The engaging means may be made of polymer-type material.

The saddle member may be substantially U-shaped. The saddle member may be made of high wear resistance polymer type material such as polyurethane, polyethylene, polypropylene, plastics, nylon or resin. The saddle member further may have internal rigid inserts to increase its structural rigidity.

The saddle member may be provided with quick release securing means for securing the saddle to the runner. The securing means may comprise a spigot and socket arrangement, the saddle and the runner being provided with complementary apertures for receiving spigots therethrough. The spigots preferably are of a polymer-type material.

The saddle member further may be provided with load bearing support formations for operatively supporting the associated screen panel substantially along the side of the panel.

BRIEF DESCRIPTION OF THE DRAWINGS

An embodiment of the invention will now be described by way of a non-limiting example and with reference to the accompanying drawings wherein.

The same reference numerals are use to denote corresponding parts in the accompanying drawings.

BEST METHOD OF CARRYING OUT THE INVENTION

Figure 1:
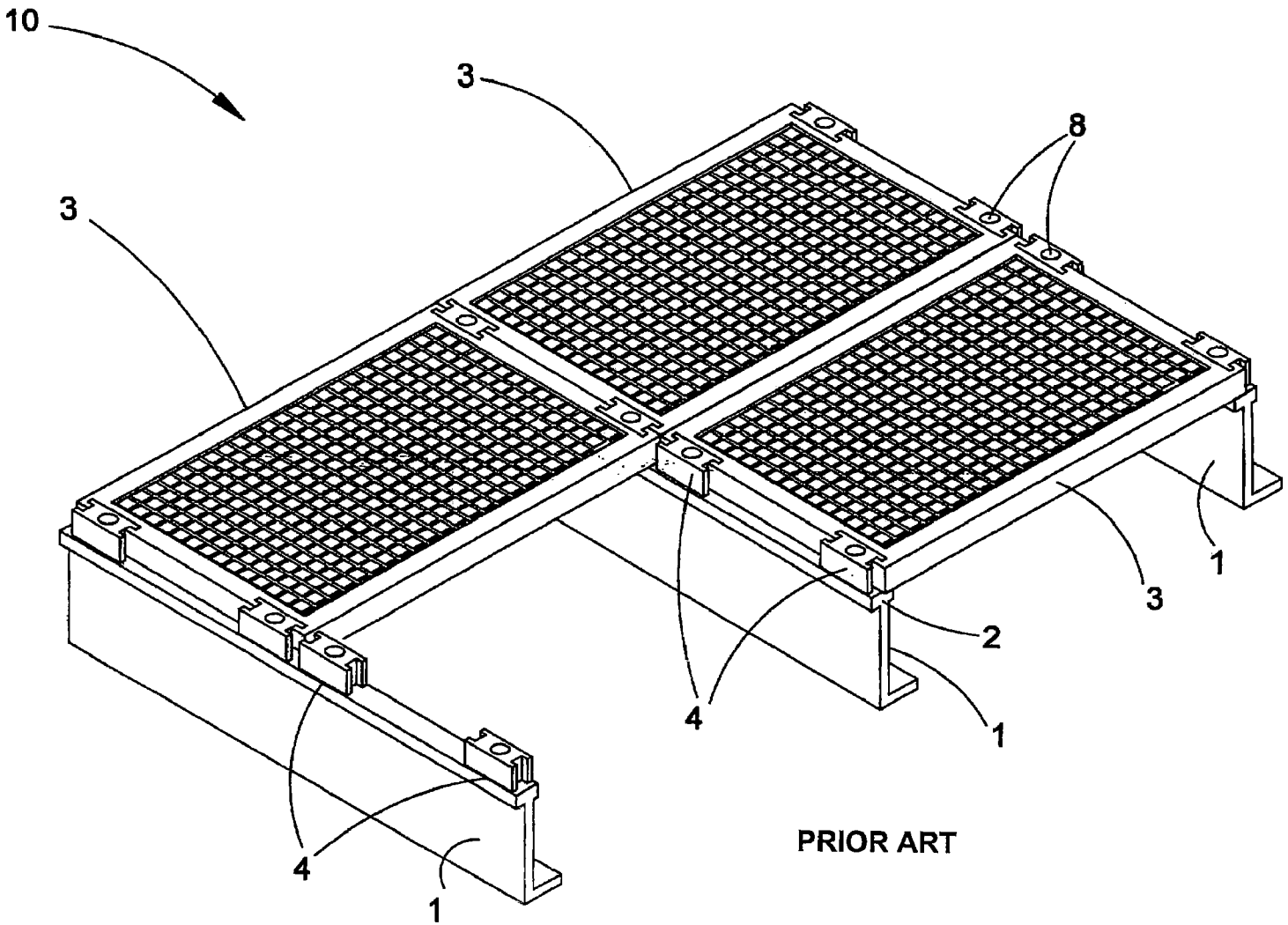
PRIOR ART FIGURE 1
FIG. 1 is a perspective cutaway view of a screen deck according to the prior art.

A prior art screen deck assembly (10) is shown in FIG. 1. Runners (1) are bolted onto a vibratory machine's grid (not shown) by specialist screen deck suppliers. Runners (1) currently use a T-piece formation (2) at their top edge. Screen panels (3) are placed edge to edge above the runners (1) and connected to the runners by means of securing inserts (4) and securing pins (8), which are inserted into apertures in the runners (not shown).

Figure 2:
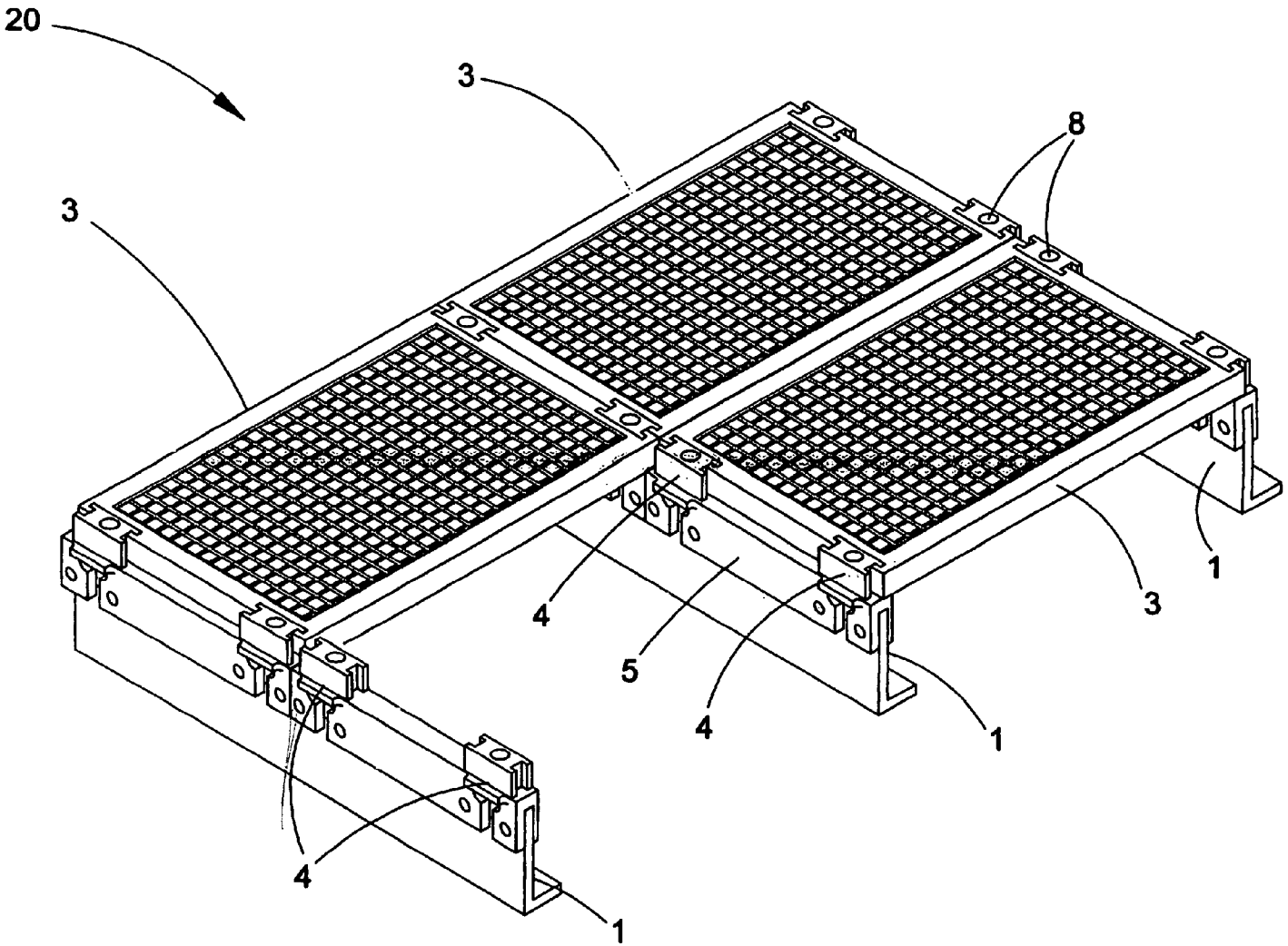
FIG. 2 is a perspective cutaway view of a vibratory screen deck in accordance with the invention.

FIG. 2 shows a screen deck assembly (20) in accordance with the invention. Runners (1) are bolted onto a vibratory machine's grid (not shown). These runners do not have T-piece formations (2) as shown in FIG. 1. Wear resistant polyurethane, or other suitable material, saddle members (5) are placed straddling the top edge of the runners (1). The saddle members (5) are fastened to the runners (1) by means of a spigot and socket configuration such as plastic fastening pins (6), which are inserted through aligning fastening apertures (7) in the saddle member (5) and the runner (1).

Figure 3:
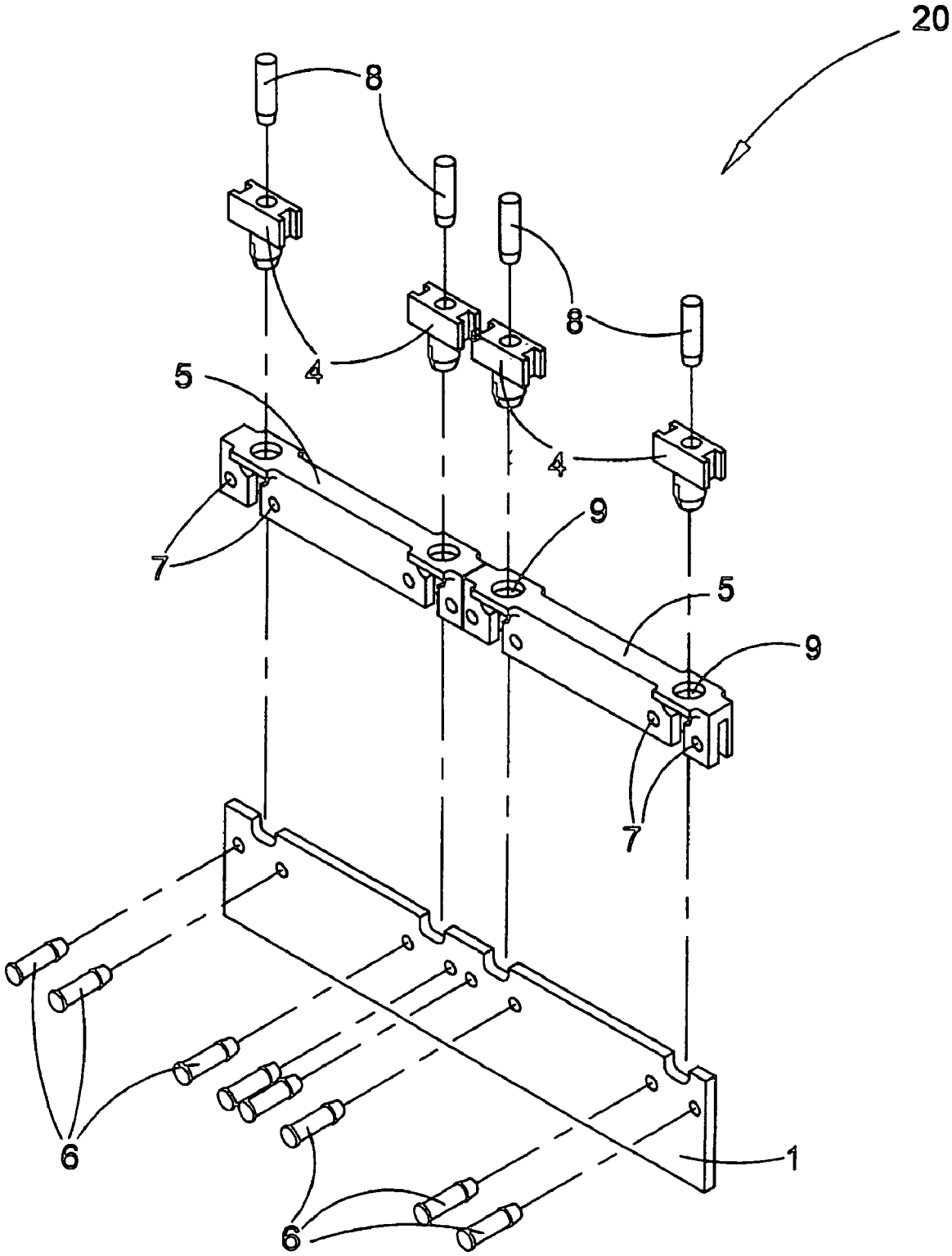
FIG. 3 is an exploded view of a screen deck runner assembly.
Figure 4:
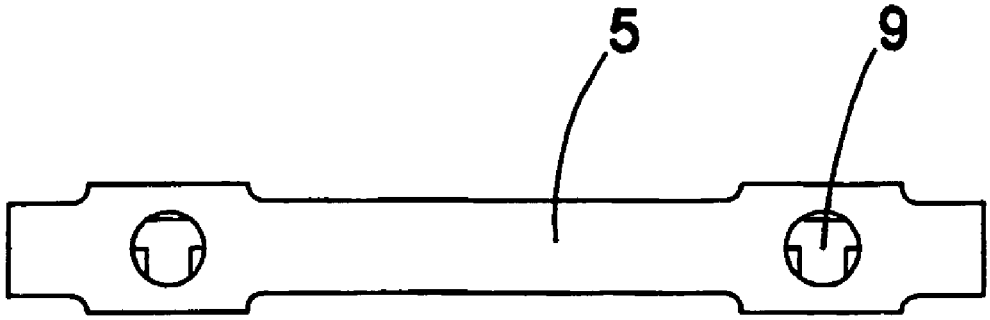
FIG. 4 is a plan of a saddle member.
Figure 5:
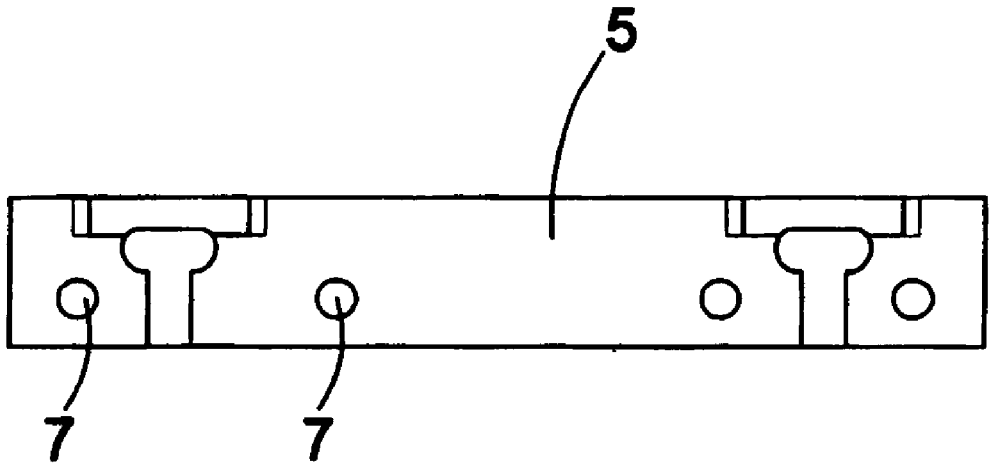
FIG. 5 is an elevation view of a saddle member.
Figure 6:
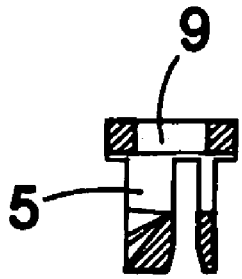
FIG. 6 is a side view of a saddle member.

Screen panels (3) are placed edge to edge above the saddle members (5), and engage with the saddle member (5) and each other by means of engaging means in the form of polyurethane engaging inserts (4) and polyethylene engaging pins (8) (see FIG. 3).

Screen panels may be removed by punching the engaging pins (8) through the saddle member (5), pulling out the engaging inserts (4) and lifting the screen panels (3). If the saddle member (5) is worn, the screen panels (3) are first removed, the fastening pins (8) are punched through the runner (1) and the saddle members (5) lifted off and replaced. The underlying runners (1) are protected from undue wear by the saddle members (5).

Figure 7:
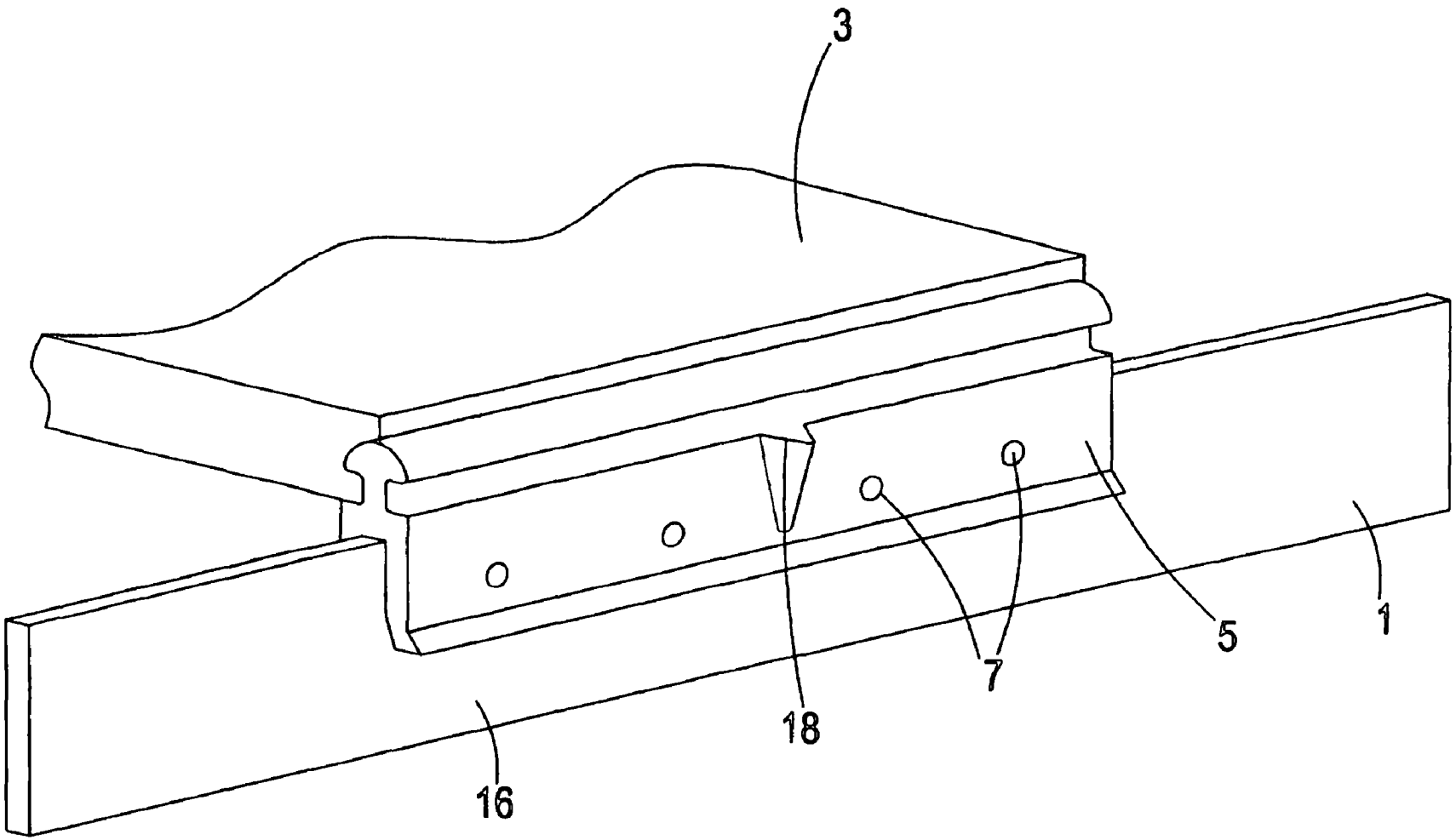
FIG. 7 is a perspective view of an alternative embodiment of the invention showing a continuous rail-type engaging means.
Figure 8:
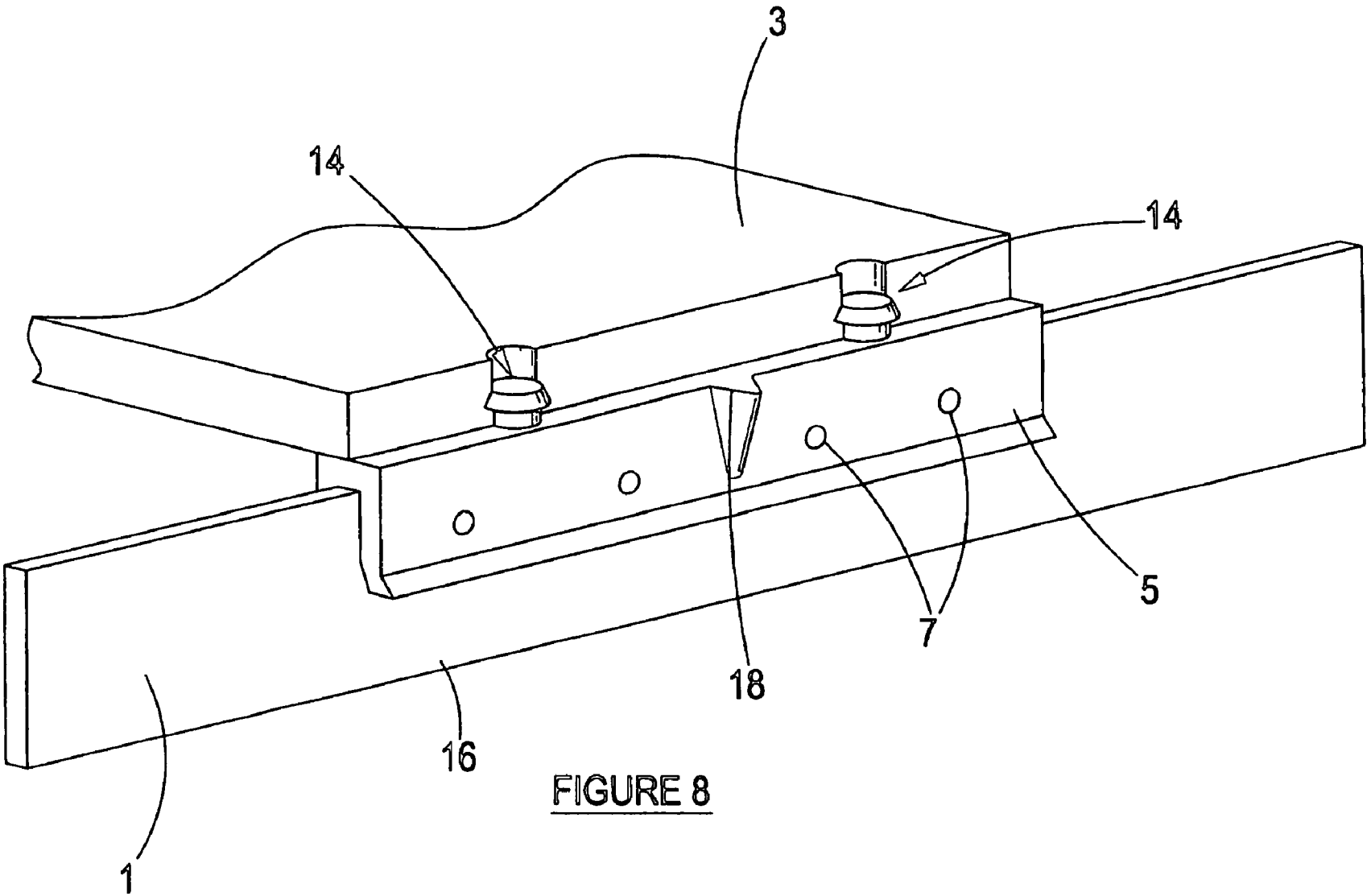
FIG. 8 is a perspective view of an alternative embodiment of the invention showing a mushroom-type engaging means.

In alternative embodiments the saddle member has an integrally formed engaging means in the form of a continuous rail-type engaging means (12, shown in FIG. 7) or a mushroom-shaped protrusion (14, shown in FIG. 8). These engaging means shown in FIGS. 7 and 8 constrain movement of the screen panel (3) in two degrees of freedom, while the engaging means shown in FIG. 2 constrains the screen panel in three degrees of freedom.

Figure 9:
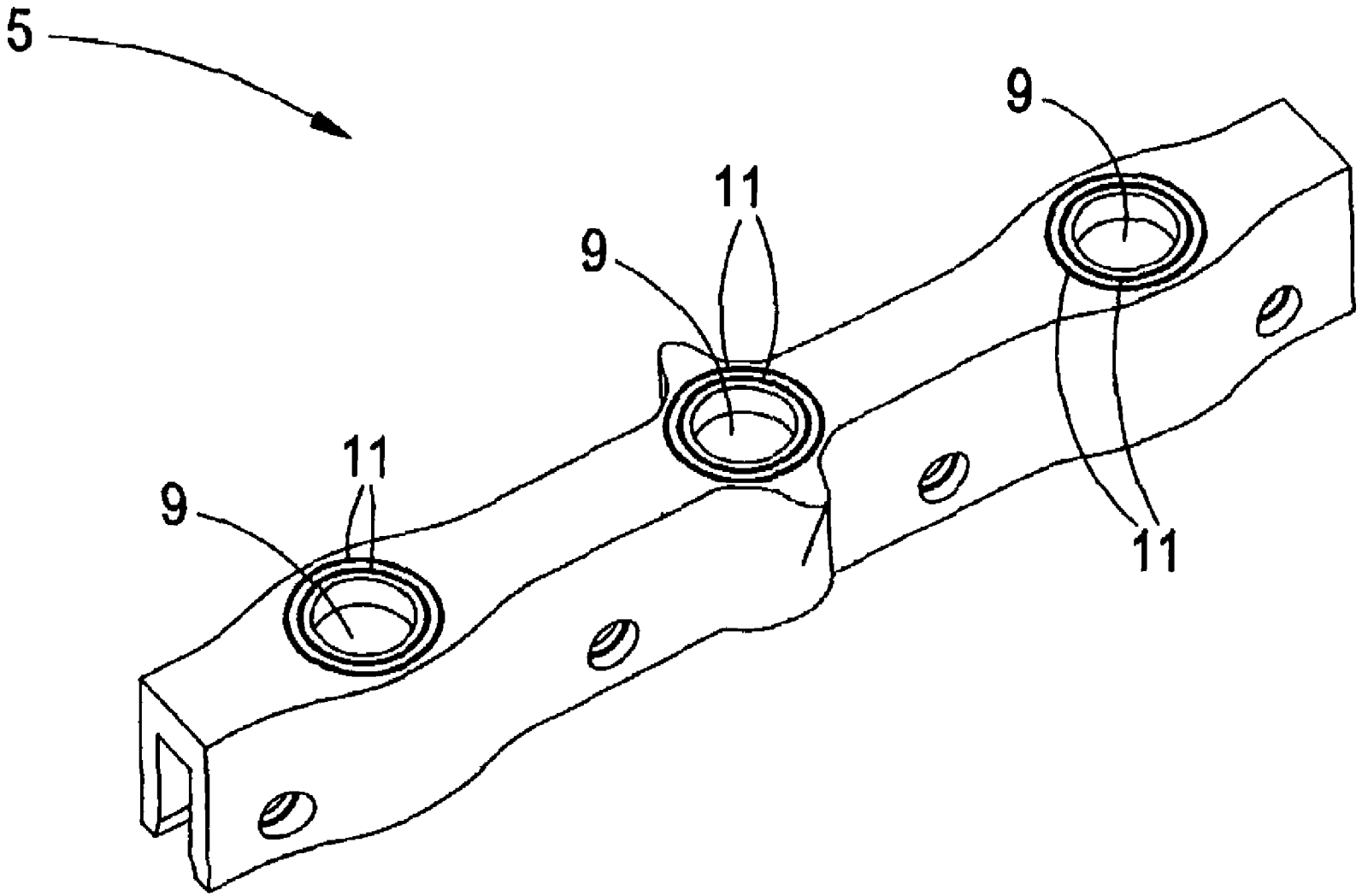
FIG. 9 is a perspective view of an alternative embodiment of a screen deck wear saddle according to the invention.

The embodiments shown in FIGS. 7, 8 and 9 show the saddle member (5) having support formations (18) intermediate along its length on which an edge of the screen panel (3) may be supported. Further, the embodiments shown in FIGS. 7 and 8 have outwardly flared formations (16) along the lower edge of the saddle member (3) to deflect screened particles (not shown), which have fallen through the screen panels (3), away from the runner (1).

The saddle member (5) has rigid metal inserts (not shown) to add rigidity to the assembly (20).

Where the engaging means for the screen panels (3) is by means of a spigot and socket formation (as shown in FIGS. 2, 3, 4, 5, 6 and 9), the engaging pins (8) are pushed into engaging sockets (9) on the engaging inserts (4). The engaging socket (9) is surrounded by annular ridges (11) shown in on the top surface of the saddle member (5) which seal against the bottom of the screen panels (5), thus preventing screened material from falling into the engaging socket (9) and causing excess wear between the saddle member (5) and the runner (1).

It will be appreciated that many variations in detail are possible without departing from the scope and spirit of the invention, substantially as defined in the consistory statements hereinabove.

The invention claimed is:

1. A screen deck assembly suitable for use in a modular-type screen deck of a screening machine, the assembly having a matrix of screen panels supported on a plurality of elongate runners; and saddle members removably mounted on the runners, the saddle members being located between the screen panels and the runners, each saddle member being configured and dimensioned to straddle at least an upper end of a runner so as to shield said upper end of the runner, the saddle members being arranged to extend substantially the full operational length of the runners; and the screen panels being coupled to the saddle members via engaging means configured to engage the screen panels to the saddle members in a releasable manner.

2. A screen deck assembly as claimed in claim 1 wherein the screen panels seat on the saddle members and are supported thereon along the sides of the screen panels.

3. A screen deck assembly as claimed in claim 1, wherein the engaging means is integrally formed with the saddle members.

4. A screen deck assembly as claimed in claim 1, wherein the engaging means comprise separate fastener members.

5. A screen deck assembly as claimed in claim 4 wherein the engaging means comprises at least one socket formation, configured and dimensioned to receive a complementarily shaped spigot for releasably engaging the screen panel in spigot and socket fashion.

6. A screen deck assembly as claimed in claim 5 wherein the socket formation is provided with an annular sealing ridge extending around the circumference of the socket.

7. A screen deck assembly as claimed in claim 1 wherein the saddle member is substantially U-shaped in cross section.

8. A screen deck assembly as claimed in claim 1 including securing means for removably securing a saddle to a runner, the securing means comprising a spigot and socket arrangement, the saddle and the runner being provided with complementary apertures for receiving spigots therethrough.

9. A screen deck assembly as claimed in claim 1 wherein the saddle member is further provided with load bearing support formations extending laterally from the saddle member for operatively supporting the associated screen panel substantially along the side of the panel.

10. A saddle member for a screen deck assembly of a modular-type screen deck of a screening machine, the assembly having a matrix of screen panels mounted on a plurality of runners, the saddle member being adapted removably to be mounted on an associated runner between the runner and a screen panel of the screen deck, the saddle member being configured and dimensioned removably to straddle at least an upper end of the associated runner so as to shield said upper end of the runner, the saddle member being one of a plurality of saddle members arranged to extend substantially the full operational lengths of the runners; and the screen panels being coupled to the saddle member via engaging means configured to engage the screen panel to the saddle members in a releasable manner.

11. A saddle member as claimed in claim 10, wherein the saddle member is substantially U-shaped in cross section.

12. A saddle member as claimed in claim 10, wherein the engaging means comprises at least one socket formation, configured and dimensioned to receive a complimentary shaped spigot for releasably engaging a screen panel in spigot and socket fashion.

13. A saddle member as claimed in claim 12 wherein the socket formation is provided with an annular sealing ridge extending around the circumference of the socket.

14. A saddle member as claimed in claim 10 wherein the saddle member has securing formations for removably securing the saddle member to a runner, wherein the securing formation comprises a socket aperture for alignment with a corresponding aperture in a runner, and into which a spigot may be received.

15. A saddle member as claimed in claim 10 wherein the saddle member is further provided with load bearing support formations extending laterally from the saddle member for operatively supporting an associated screen panel at the side of the panel.

16. A saddle member as claimed in claim 10 wherein the saddle member is further provided with outwardly flared deflecting formation towards the lower edge of the saddle member for operatively deflecting falling screened material away from the sides of the runner it is mounted on.

* * * * *